US010620571B2

(12) United States Patent
Hayami

(10) Patent No.: US 10,620,571 B2
(45) Date of Patent: Apr. 14, 2020

(54) IMAGE CARRIER AND IMAGE FORMING APPARATUS

(71) Applicant: Konica Minolta, Inc., Tokyo (JP)

(72) Inventor: Toshiki Hayami, Tokyo (JP)

(73) Assignee: KONICA MINOLTA, INC., Tokyo (JP)

( * ) Notice: Subject to any disclaimer, the term of this patent is extended or adjusted under 35 U.S.C. 154(b) by 0 days.

(21) Appl. No.: 16/294,712

(22) Filed: Mar. 6, 2019

(65) Prior Publication Data

US 2019/0286016 A1 Sep. 19, 2019

(30) Foreign Application Priority Data

Mar. 13, 2018 (JP) ..... 2018-045510

(51) Int. Cl.
*G03G 15/20* (2006.01)
*G03G 15/16* (2006.01)

(52) U.S. Cl.
CPC ..... *G03G 15/162* (2013.01)

(58) Field of Classification Search
CPC .... G03G 5/08; G03G 9/09708; G03G 9/1139; G03G 15/16; G03G 15/162; G03G 15/1685; G03G 15/5054
USPC ..... 399/107, 110, 116, 121, 159, 162, 297, 399/298, 302, 308
See application file for complete search history.

(56) References Cited

U.S. PATENT DOCUMENTS 9,052,644 B2 * 6/2015 Yagi ..... G03G 15/162

FOREIGN PATENT DOCUMENTS

JP 2012-113197 * 6/2012 ..... G03G 15/16
JP 2014-109586 A 6/2014

* cited by examiner

*Primary Examiner* — Hoan H Tran
(74) *Attorney, Agent, or Firm* — Lucas & Mercanti, LLP

(57) ABSTRACT

An intermediate transfer belt (image carrier) includes a first layer and a surface layer disposed on the first layer and including an inorganic oxide containing an organic component, in which when the surface layer has a layer thickness of A μm and the first layer has a ten-point average roughness of B μm, a relationship of $0.25 \times A \leq B$ is satisfied.

5 Claims, 8 Drawing Sheets

| | COMPARATIVE EXAMPLE | (1) | (2) | (3) | (4) | (5) | (6) | (7) | (8) | (9) |
|---|---|---|---|---|---|---|---|---|---|---|
| Rz (μm) OF BASE MATERIAL LAYER 421a | 0.32 | 0.41 | 0.48 | 0.68 | 0.92 | 1.19 | 1.45 | 1.61 | 1.77 | 2.01 |
| Rz (μm) OF SURFACE LAYER 421b | 0.65 | 0.63 | 0.66 | 0.66 | 0.69 | 0.65 | 0.67 | 0.68 | 0.98 | 1.1 |
| NUMBER OF PEELED LATTICE CELLS IN CROSS-CUT TEST | 43/100 | 40/100 | 19/100 | 0/100 | 0/100 | 0/100 | 0/100 | 0/100 | 0/100 | 0/100 |

FIG. 4

| | COMPARATIVE EXAMPLE | (1) | (2) | (3) | (4) | (5) | (6) | (7) | (8) | (9) |
|---|---|---|---|---|---|---|---|---|---|---|
| Rz (μm) OF BASE MATERIAL LAYER 421a | 0.31 | 0.45 | 0.52 | 0.72 | 1.08 | 1.19 | 1.45 | 1.61 | 1.77 | 2.01 |
| Rz (μm) OF SURFACE LAYER 421b | 0.71 | 0.65 | 0.68 | 0.66 | 0.7 | 0.66 | 0.88 | 0.93 | 1.22 | 1.45 |
| NUMBER OF PEELED LATTICE CELLS IN CROSS-CUT TEST | 52/100 | 28/100 | 0/100 | 0/100 | 0/100 | 0/100 | 0/100 | 0/100 | 0/100 | 0/100 |

FIG. 5

| | (1) | (2) | (3) | (4) | (5) | (6) | (7) | (8) | (9) | (10) | (11) |
|---|---|---|---|---|---|---|---|---|---|---|---|
| SURFACE ROUGHNESS Rz (μm) | 0.4 | 0.5 | 0.6 | 0.7 | 0.8 | 0.9 | 1.0 | 1.2 | 1.3 | 1.4 | 1.5 |
| CLEANING PERFORMANCE | A | A | A | A | A | A | A | A | B | C | C |

FIG. 6

| | (1) | (2) | (3) | (4) | (5) | (6) | (7) | (8) | (9) | (10) | (11) | (12) | (13) |
|---|---|---|---|---|---|---|---|---|---|---|---|---|---|
| LAYER THICKNESS OF SURFACE LAYER (μm) | 0.4 | 0.6 | 0.8 | 1.0 | 1.2 | 1.4 | 1.6 | 2.0 | 2.4 | 2.8 | 3.0 | 3.2 | 3.4 |
| TRANSFER PERFORMANCE | D | C | C | B | B | A | A | A | A | A | A | A | A |
| EVALUATION OF CRACK | B | B | B | B | B | B | B | B | B | B | B | D | D |

FIG. 8

IMAGE CARRIER AND IMAGE FORMING APPARATUS

CROSS REFERENCE TO RELATED APPLICATIONS

The entire disclosure of Japanese Patent Application No. 2018-045510 filed on Mar. 13, 2018 is incorporated herein by reference in its entirety.

BACKGROUND

Technological Field

The present invention relates to an image carrier and an image forming apparatus.

Description of Related Art

In general, image forming apparatuses (such as printers, copiers, and facsimile machines) using electrophotographic processing technology are configured to irradiate (expose) a charged photoconductor drum with laser light according to the image data to form an electrostatic latent image thereon. Then, a toner is supplied from a developing device to the photoconductor drum on which the electrostatic latent image is formed, thereby visualizing the electrostatic latent image to form a toner image. Further, the toner image is directly or indirectly transferred onto a sheet, and thereafter, heated and pressurized for fixation to form an image on the sheet.

There also has been studied that an intermediate transfer belt (an image carrier) in which a surface layer (sometimes referred to as a surface or a coat layer) based on silicon dioxide ($SiO_2$) is applied to a base material layer (sometimes referred to as a base layer) containing polyimide (PI) is used in the image forming apparatus (see, for example, Japanese Patent Application Laid-Open No. 2014-109586. Hereinafter referred to as Patent Literature 1). The surface layer reduces an electrostatic adhesion force of a toner, so that transfer efficiency is improved.

As disclosed in Patent Literature 1, in the intermediate transfer belt having a base material layer and a surface layer, the surface layer is deteriorated (shrunk) due to energization, which in turn lowers adhesiveness between the surface layer and the base material layer. When the intermediate transfer belt with lowered adhesiveness is continuously used, the surface layer peels off, resulting in deterioration of transfer performance.

SUMMARY

It is an object of the present invention to provide an image carrier and an image forming apparatus that can improve adhesiveness of a surface layer to suppress deterioration of transfer performance.

To achieve at least one of the abovementioned objects, according to an aspect of the present invention, an image carrier reflecting one aspect of the present invention comprises:

a first layer; and a surface layer disposed on the first layer and including an inorganic oxide containing an organic component, wherein, when the surface layer has a layer thickness of A μm and the first layer has a ten-point average roughness of B μm, a relationship of an expression (1) is satisfied:

$$0.25 \times A \leq B \quad (1).$$

To achieve at least one of the abovementioned objects, according to another aspect of the present invention, an image forming apparatus reflecting the other aspect of the present invention comprises: the image carrier described above.

BRIEF DESCRIPTION OF DRAWINGS

The advantages and features provided by one or more embodiments of the invention will become more fully understood from the detailed description given hereinbelow and the appended drawings which are given by way of illustration only, and thus are not intended as a definition of the limits of the present invention:

FIG. 4 is a diagram illustrating an example of evaluation results of adhesiveness of a surface layer according to Embodiment 1;

FIG. 5 is a diagram illustrating another example of the evaluation results of adhesiveness of the surface layer according to Embodiment 1;

FIG. 6 is a diagram illustrating an example of evaluation results of cleaning performance according to Embodiment 2;

FIG. 8 is a diagram illustrating an example of evaluation results of transfer performance and occurrence of a crack according to Embodiment 3.

DETAILED DESCRIPTION OF EMBODIMENTS

Hereinafter, one or more embodiments of the present invention will be described with reference to the drawings. However, the scope of the invention is not limited to the disclosed embodiments.

Embodiment 1

[Configuration of Image Forming Apparatus]

Figure 1:
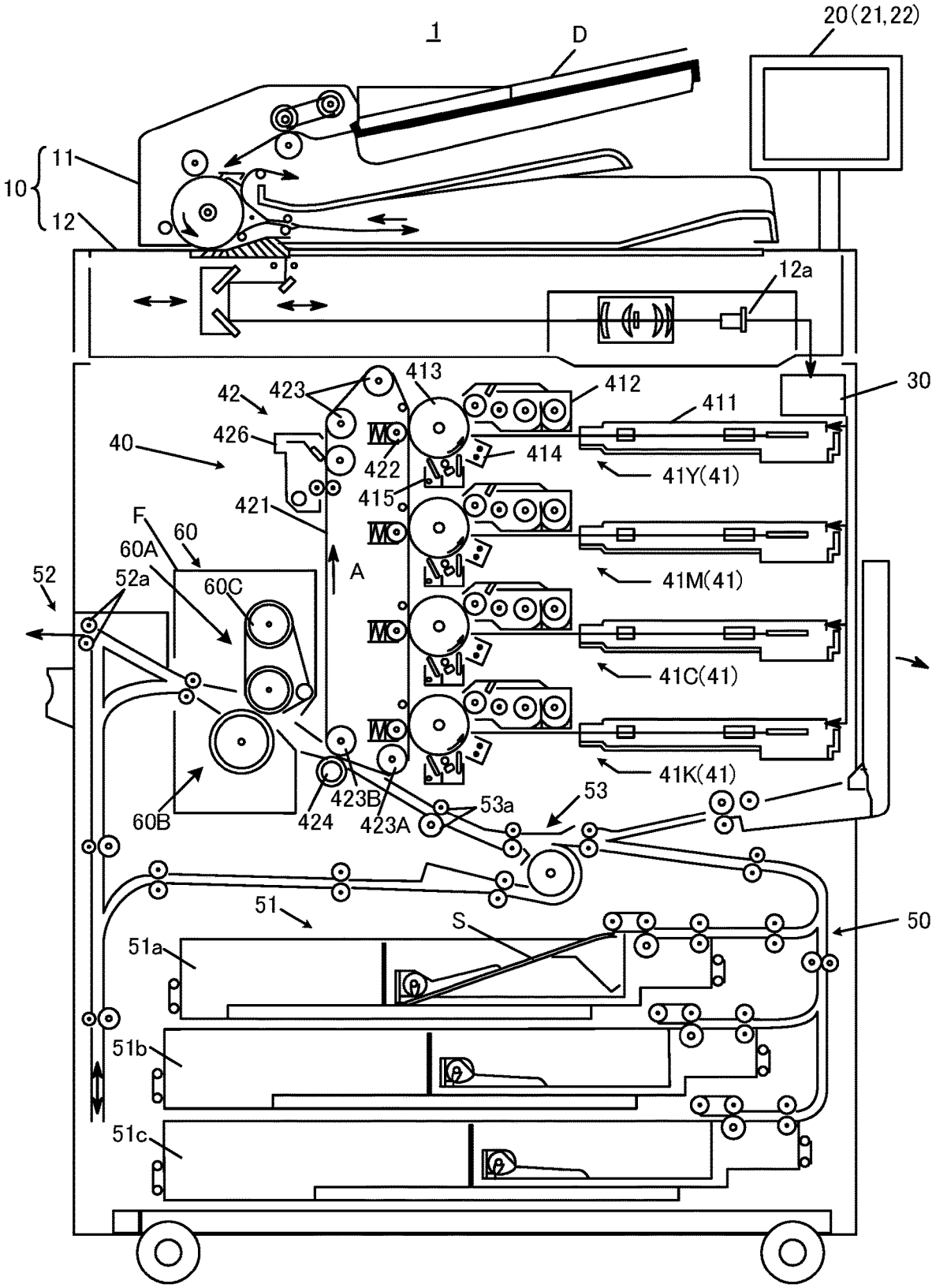
FIG. 1 is a diagram schematically illustrating an overall configuration of an image forming apparatus according to Embodiment 1.
Figure 2:
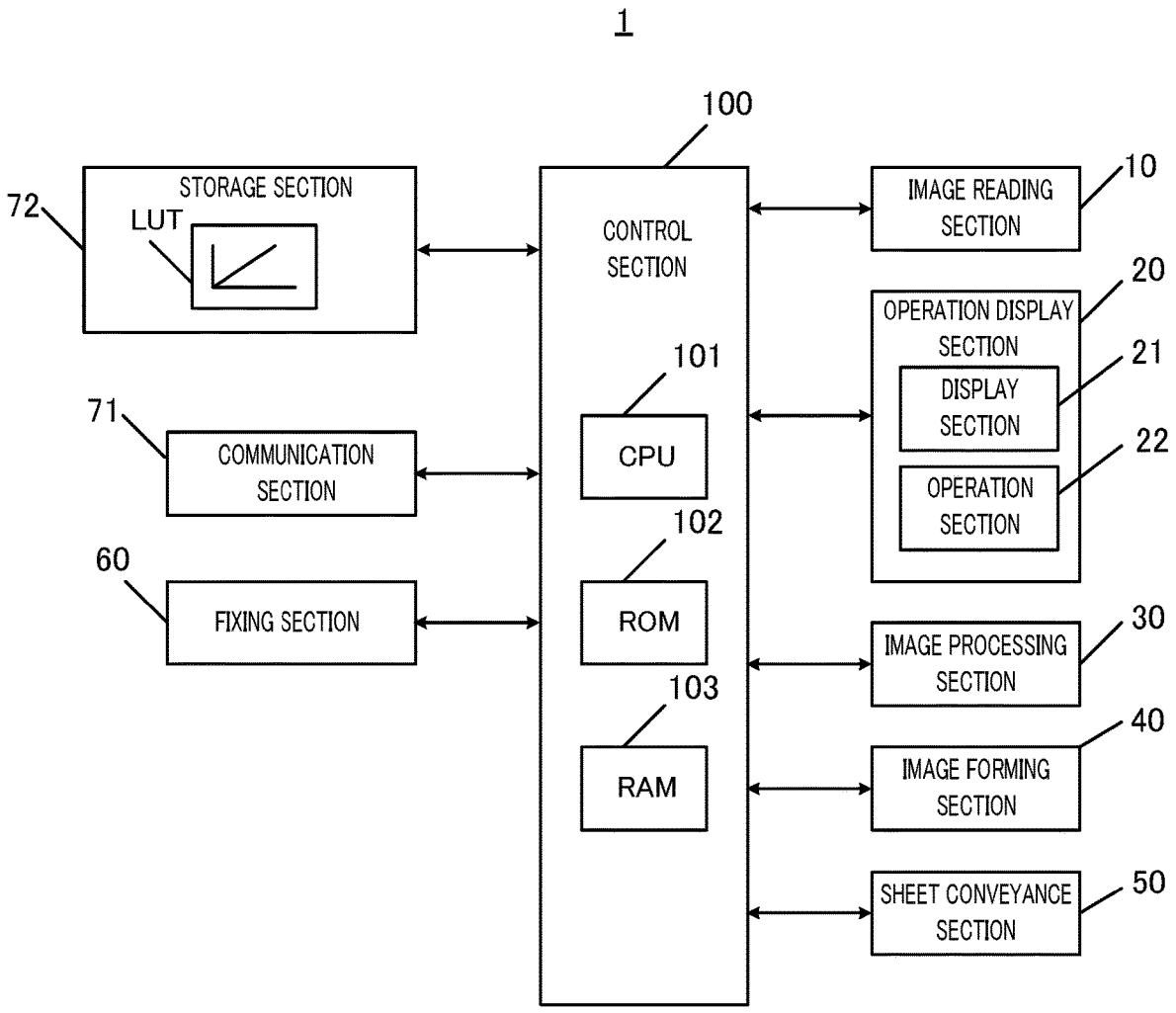
FIG. 2 is a diagram illustrating a major part of a control system of the image forming apparatus according to Embodiment 1.

FIG. 1 is a diagram schematically illustrating an overall configuration of image forming apparatus 1 according to the present embodiment. FIG. 2 is a diagram illustrating a major part of a control system of image forming apparatus 1 according to the present embodiment. Image forming apparatus 1 illustrated in FIGS. 1 and 2 is a color image forming apparatus using an intermediate transfer system using electrophotographic processing technology. In other words, image forming apparatus 1 transfers Y (yellow), M (magenta), C (cyan), and K (black) toner images formed on respective photoconductor drums 413 onto intermediate transfer belt 421 (image carrier) so that they are superimposed on intermediate transfer belt 421 (i.e., primary transfer). Image forming apparatus 1 then transfers the superimposed images onto sheet S (recording medium) to thereby form an image (i.e., secondary transfer). It should be noted that image forming apparatus 1 may be configured to form a monochromatic image (e.g., monochrome image).

Image forming apparatus 1 employs a tandem system having photoconductor drums 413 corresponding to four colors YMCK disposed in tandem in the running direction of intermediate transfer belt 421, so that the respective color toner images are sequentially transferred onto intermediate transfer belt 421 in one procedure.

As illustrated in FIG. 2, image forming apparatus 1 includes image reading section 10, operation display section 20, image processing section 30, image forming section 40, sheet conveyance section 50, fixing section 60, and control section 100.

Control section 100 includes central processing unit (CPU) 101, read only memory (ROM) 102, random access memory (RAM) 103, and the like. CPU 101 reads a program corresponding to content of a process, from ROM 102, expands the program into RAM 103, and controls operations of respective blocks of image forming apparatus 1 in a centralized manner in cooperation with the expanded program, with reference to various data stored in storage section 72. Storage section 72 includes, for example, a nonvolatile semiconductor memory (so-called flash memory) and/or a hard disk drive.

Control section 100 transmits and receives various data to and from an external device (e.g., personal computer) connected to a communication network such as local area network (LAN) or wide area network (WAN) via communication section 71. Control section 100 receives, for example, image data transmitted from the external device, and forms an image on sheet S based on this image data (input image data). Communication section 71 includes, for example, a communication control card such as a LAN card.

Image reading section 10 includes auto document feeding device 11 called auto document feeder (ADF), document image scanning device 12 (scanner), and the like.

Auto document feeding device 11 feeds document D placed on a document tray by a conveyance mechanism, and sends out document D to document image scanning device 12. Auto document feeding device 11 can successively read images (including both sides) of many documents D placed on the document tray, at once.

Document image scanning device 12 optically scans a document fed from auto document feeding device 11 onto a contact glass, or a document placed on the contact glass, images reflected light from the document onto a light receiving surface of charge coupled device (CCD) sensor 12*a*, and reads a document image. Image reading section 10 generates input image data based on a result of reading by document image scanning device 12. Image processing section 30 applies predetermined image processing to this input image data.

Operation display section 20 includes, for example, a touch-panel liquid crystal display (LCD), and functions as display section 21 and operation section 22. Display section 21 displays various operation screens, the state of the image, the operation status of each function and the like, according to display control signals input from the control section 100. Operation section 22 includes various operation keys such as a numeric keypad and a start key to receive various input operations by a user, and to output operation signals to control section 100.

Image processing section 30 includes a circuit and the like that performs digital image processing for the input image data, depending on default or user settings. Image processing section 30 performs, for example, tone correction based on tone correction data (tone correction table), under control of control section 100. Moreover, image processing section 30 applies various correction processes, such as color correction and shading correction, a compression process and the like to the input image data, in addition to the tone correction. Image forming section 40 is controlled based on such processed image data.

Image forming section 40 includes image forming units 41Y, 41M, 41C, and 41K that form images with colored toner for a Y-component, an M-component, a C-component, and a K-component, respectively, based on the input image data; intermediate transfer unit 42; and the like.

Image forming units 41Y, 41M, 41C, and 41K for the Y-component, the M-component, the C-component, and the K-component have similar configurations. For convenience of illustration and explanation, common components are denoted by the same reference numeral, and Y, M, C or K is added to the reference numeral to differentiate each component. In FIG. 1, only components of image forming unit 41Y for the Y-component are assigned reference numerals, which are omitted for components of the other image forming units 41M, 41C and 41K.

Image forming unit 41 includes exposure device 411, developing device 412, photoconductor drum 413, charging device 414, drum cleaning device 415, and the like.

Exposure device 411 includes, for example, a semiconductor laser, and emits laser light corresponding to each color-component image, to photoconductor drum 413. This forms an electrostatic latent image of each color component on the surface of photoconductor drum 413 due to a potential difference from its surroundings.

Developing device 412 is, for example, a developing device employing a two-component reversal development system, and forms a toner image by adhering toner of each color component to the surface of photoconductor drum 413 to visualize the electrostatic latent image. Developing device 412 includes a developing sleeve disposed so as to be opposed to photoconductor drum 413 through a development region. For example, a direct-current developing bias having the same polarity as the charging polarity of the charging device 414, or a developing bias in which a direct-current voltage having the same polarity as the charging polarity of the charging device 414 is superposed on an alternating-current voltage is applied to the developing sleeve. As a result of this, reversal development in which toner is adhered to the electrostatic latent image formed by exposure device 411 is performed.

Photoconductor drum 413 includes, for example, an organic photoconductor in which a photosensitive layer made of resin containing an organic photoconductive member is formed on the outer peripheral surface of a drum-like metal substrate.

Control section 100 controls drive current supplied to a drive motor (not illustrated) which rotates photoconductor drum 413, to thereby rotate photoconductor drum 413 at a constant peripheral speed.

Charging device 414 is, for example, an electrification charger and evenly negatively charges the photoconductive surface of photoconductor drum 413 by generating corona discharge.

Drum cleaning device 415 has a flat drum cleaning blade to be brought into contact with the surface of photoconductor drum 413, and made of an elastic material, to remove toner remaining on the surface of photoconductor drum 413 without being transferred to intermediate transfer belt 421.

Intermediate transfer unit 42 includes intermediate transfer belt 421, primary transfer rollers 422, a plurality of support rollers 423, secondary transfer roller 424, belt cleaning device 426, and the like.

Intermediate transfer belt 421 is composed of an endless belt, which is stretched in a loop manner by the plurality of support rollers 423. At least one of the plurality of support rollers 423 includes a driving roller and the others include driven rollers. For example, roller 423A disposed downstream of primary transfer roller 422 for the K-component in the belt running direction is preferably a driving roller. This makes it easier to maintain a constant running speed of the belt in the primary transfer section. Intermediate transfer belt 421 runs at a constant speed in the direction of arrow A corresponding to the rotation of driving rollers 423A.

Primary transfer roller 422 is disposed on the inner peripheral surface side of intermediate transfer belt 421 so as to be opposed to photoconductor drum 413 for each color component. When primary transfer roller 422 is pressed against photoconductor drum 413 with intermediate transfer belt 421 being interposed therebetween, a primary transfer nip is formed to transfer a toner image from photoconductor drum 413 onto intermediate transfer belt 421.

Secondary transfer roller 424 is disposed on the outer peripheral surface side of intermediate transfer belt 421 so as to be opposed to backup roller 423B disposed downstream of driving roller 423A in the belt running direction. When secondary transfer roller 424 is pressed against backup roller 423B with intermediate transfer belt 421 being interposed therebetween, a secondary transfer nip is formed to transfer a toner image from intermediate transfer belt 421 onto sheet S.

While intermediate transfer belt 421 passes through the primary transfer nip, the respective toner images on photoconductor drums 413 are sequentially transferred onto intermediate transfer belt 421 in a superimposed manner (i.e., primary transfer). Specifically, the toner images are electrostatically transferred onto intermediate transfer belt 421 by applying a primary transfer bias to primary transfer roller 422 and imparting electric charges of a polarity opposite to the toner to the rear surface side (side in contact with primary transfer roller 422) of intermediate transfer belt 421.

Thereafter, while sheet S passes through the secondary transfer nip, the toner image on intermediate transfer belt 421 is transferred onto sheet S (i.e., secondary transfer). Specifically, the toner images are electrostatically transferred onto sheet S by applying a secondary transfer bias to secondary transfer roller 424 and imparting electric charges of a polarity opposite to the toner to the rear surface side (side in contact with secondary transfer roller 424) of sheet S. Sheet S having the toner image transferred thereon is conveyed toward fixing section 60.

Belt cleaning device 426 removes residual toner remaining on the surface of intermediate transfer belt 421 after the secondary transfer. Alternatively, a configuration (a so-called belt-type secondary transfer unit) in which a secondary transfer belt is stretched in a loop manner by a plurality of support rollers including a secondary transfer roller may be employed instead of secondary transfer roller 424.

Fixing section 60 includes upper fixing section 60A having a fixing-surface-side member disposed on the fixing surface (surface on which the toner image is formed) side of sheet S, lower fixing section 60B having a rear-surface-side member disposed on the rear surface (surface opposite to the fixing surface) side of sheet S, heat source 60C, and the like. The rear-surface-side supporting member is pressed against the fixing-surface-side member to thereby form a fixing nip that holds and conveys sheet S.

At the fixing nip, fixing section 60 heats and pressurizes sheet S onto which a toner image has been transferred (i.e., secondary transfer) and then conveyed, to thereby fix the toner image on sheet S. Fixing section 60 is disposed as a unit in fixing device F. In addition, fixing device F may be provided with an air separation unit that blows air to separate sheet S from the fixing-surface-side member or the rear-surface-side support member.

Sheet conveyance section 50 includes sheet feeding section 51, sheet ejection section 52, and conveyance passage section 53, and the like. Different sets of sheets S (standard sheets, special sheets), which have been identified based on their basis weight, size, and the like are housed in three sheet feeding tray units 51*a* to 51*c* included in sheet feeding section 51. Conveyance passage section 53 includes a plurality of conveyance roller pairs such as a pair of registration rollers 53*a*.

Sheets S housed in sheet feeding tray units 51*a* to 51*c* are sent out one by one from top, and conveyed to image forming section 40 by conveyance passage section 53. At this time, a registration roller section in which the pair of registration rollers 53*a* are arranged corrects skew of sheet S fed thereto, and the conveyance timing is adjusted. Then, in image forming section 40, the toner image on intermediate transfer belt 421 is transferred to one side of sheet S at one time (i.e., secondary transfer), and a fixing process is performed in fixing section 60. Sheet S having an image formed thereon is ejected out of image forming apparatus 1 by sheet ejection section 52 including ejection rollers 52*a*.

[Configuration of Intermediate Transfer Belt]

Next, the configuration of intermediate transfer belt 421 will be described.

Figure 3:
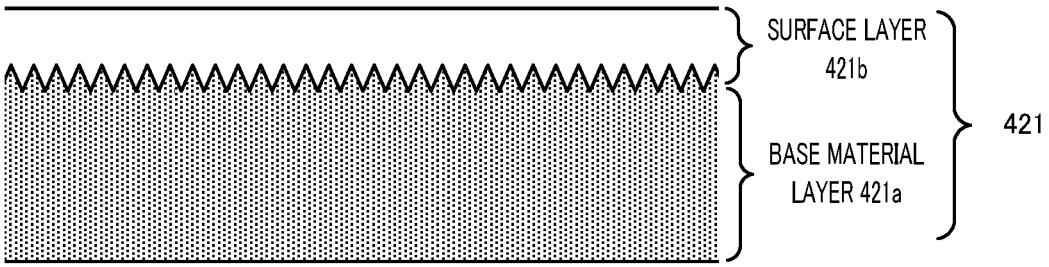
FIG. 3 is a diagram illustrating an example of a cross section of an intermediate transfer belt according to Embodiment 1.

FIG. 3 is a diagram schematically illustrating an example of a cross section of intermediate transfer belt 421. Intermediate transfer belt 421 illustrated in FIG. 3 has at least two layers including base material layer 421*a* and surface layer 421*b* disposed on base material layer 421*a*.

In base material layer 421*a*, for example, synthetic resin in which a conductive material or the like is dispersed, such as polyimide (PI) resin, polyamide imide resin, polyphenylene sulfide resin, polyamide resin, or the like is used. Base material layer 421*a* may be made of a single layer or plural layers.

In surface layer 421*b*, inorganic oxide, for example, silicon dioxide ($SiO_2$) based material is used. For example, as silicon oxide containing an alkyl group, a siloxane compound such as methyltrimetoxysilane, dimethyldimethoxysilane, phenyltrimethoxysilane, methyltriethoxysilane, or the like may be used in surface layer 421*b*.

It should be noted that the materials used in base material layer 421*a* and surface layer 421*b* are not limited thereto.

In the present embodiment, roughness is imparted to the surface of base material layer 421*a* to which surface layer 421*b* (coat layer) is applied, as illustrated in FIG. 3.

As illustrated in FIG. 3, by imparting roughness to base material layer 421*a* of intermediate transfer belt 421, the contact area between base material layer 421*a* and surface layer 421*b* increases. The increase in the contact area between base material layer 421*a* and surface layer 421*b* results in improvement of adhesive force between base material layer 421*a* and surface layer 421*b*. This can suppress peeling of surface layer 421*b* caused by deterioration of surface layer 421*b* due to energization, to thereby suppress deterioration of transfer performance at intermediate transfer belt 421.

The present inventors has evaluated adhesiveness between base material layer 421*a* and surface layer 421*b* by the following method and criteria.

In the following description, the surface roughness Rz [nm] of surface layer 421*b* refers to a ten-point average roughness measured with a surface roughness measuring instrument, Surfcorder SE3500, manufactured by Kosaka Laboratory, Ltd. As measurement conditions of the ten-point average roughness Rz, the feeding speed is 0.2 mm/sec, the trace length is 12.5 mm, the cut-off value λc is 2.5 mm, and the evaluation length is set to a length five times as large as the cut-off value.

A method of manufacturing surface layer 421*b* may be a dip coating method, a spray coating method, an atmospheric pressure plasma CVD method, or the like, but not limited thereto.

The resistance (surface resistivity) of base material layer 421*a* before surface layer 421*b* is applied is preferably in the range of, for example, 9.0 to 12.0 log Ω/sq. The resistance of surface layer 421*b* alone is preferably a value 0.5 to 2.0 log Ω/sq higher than the resistance of base material layer 421*a*. The resistance of intermediate transfer belt 421 with base material layer 421*a* and surface layer 421*b* being laminated thereon is in the range of preferably 9.1 to 12.1 log Ω/sq, and more preferably 9.5 to 11.0 log Ω/sq. The resistance of intermediate transfer belt 421 as described above is measured using a resistivity meter (Hiresta UP manufactured by Mitsubishi Chemical Analytech Co., Ltd.) by applying a voltage of 500 V with an insulating plate opposed thereto. The resistance of surface layer 421*b* alone is measured with a conductive plate opposed thereto.

Table 1 shows parameters of image forming apparatus 1 (evaluation machine) used in the evaluation of adhesiveness.

TABLE 1

| Machine | | | Full color device adopting intermediate transfer member |
|---|---|---|---|
| Speed | | | 400 mm/sec |
| Secondary transfer belt 421 | | | Described separately |
| Secondary transfer section | Backup roller 423B | Material | NBR rubber |
| | | Shape | ϕ38 straight |
| | | Properties | Aske-C71°, 7.5 log Ω |
| | Secondary transfer roller 424 | Material | SUS roller |
| | | Shape | ϕ38 straight |
| | | Properties | — |
| | Pressing force | | 80N |
| Belt cleaning device 426 | Material of blade | | Urethane rubber |
| | Contact force | | 20N |
| | Contact angle | | 20° |
| | Stretching roller | | Made of SUS, ϕ38 straight |

Base material layer 421*a* of intermediate transfer belt 421 used a material including polyimide resin having a layer thickness of 65 μm and a resistance of 10.2 log Ω/sq. Surface layer 421*b* of intermediate transfer belt 421 uses two kinds of silicon dioxide-based materials, i.e., one having a layer thickness of 2.7 μm (corresponding to FIG. 4 described later) and one having a layer thickness of 2.0 μm (corresponding to FIG. 5 described later).

As the materials used in surface layer 421*b*, the masses of both tetraalkoxysilane ($Si(OR)_4$) and methyltrimethoxysilane ($(CH_3)_3SiCH_3$) added are adjusted so that the content of an organic component in surface layer 421*b* is 20% by mass. The organic component is contained in surface layer 421*b* in order to prevent a crack from occurring, because the crack may occur when surface layer 421*b* of which the component is an inorganic oxide (silicon dioxide) alone cannot follow the movement of intermediate transfer belt 421 that has been stretched by the rollers.

Under the above-mentioned conditions, intermediate transfer belts 421 were manufactured by changing the surface roughness Rz of base material layer 421*a* (patterns (1) to (9)). For example, rollers around which sheets of wrapping paper having different surface roughness levels are wound are rotated together to obtain base material layers 421*a* having different surface roughnesses Rz. It should be noted that a method of imparting surface roughness to the base material layer is not limited to the above-mentioned method. For example, a method of roughening a surface of a mold may be used. Base material layer 421*a* (polyimide resin) as is (i.e., in a state where its surface is not roughened) has a surface roughness Rz of about 0.3 μm.

FIG. 4 illustrates results of evaluating adhesiveness in image forming apparatus 1 according to the following criteria when surface layer 421*b* has a layer thickness of 2.7 μm. In addition, FIG. 5 illustrates results of evaluating adhesiveness in image forming apparatus 1 according to the following criteria when surface layer 421*b* has a layer thickness of 2.0 μm.

Specifically, as the method of evaluating the adhesiveness between base material layer 421*a* and surface layer 421*b*, a cross-cut test was conducted in which a transfer voltage was applied to intermediate transfer belt 421 in a transfer press-contact state, the belt ran at idle for 200 hr, and thereafter, the number of peeled lattice cells in 100 lattice cells was evaluated. That is, a smaller number of peeled lattice cells results in more excellent adhesiveness between base material layer 421*a* and surface layer 421*b*.

FIGS. 4 and 5 each illustrate evaluation results in the state where its surface is not roughened (base material layer 421*a* has surface roughnesses Rz of 0.32 μm in FIGS. 4 and 0.31 μm in FIG. 5) as Comparative Example.

As illustrated in FIGS. 4 and 5, it can be confirmed that a higher surface roughness Rz of base material layer 421*a* results in a smaller number of peeled lattice cells, so that adhesiveness between base material layer 421*a* and surface layer 421*b* is improved.

Specifically, according to FIG. 4, it can be confirmed that when the surface roughness Rz of base material layer 421*a* is 0.68 μm or more (patterns (3) to (9)), the number of peeled lattice cells is "0", and the adhesiveness is not deteriorated. In addition, according to FIG. 5, it can be confirmed that when the surface roughness Rz of base material layer 421*a* is 0.52 μm or more (patterns (2) to (9)), the number of peeled lattice cells is "0", and the adhesiveness is not deteriorated.

When the number of peeled lattice cells is "0", the lower limit of the surface roughness Rz of base material layer 421*a* is 0.68 μm in FIG. 4 (surface layer 421*b* has a layer thickness of 2.7 μm) and 0.52 μm in FIG. 5 (surface layer 421*b* has a layer thickness of 2.0 μm). Therefore, according to the studies of the present inventors, it has been found that the surface roughness Rz (lower limit) of base material layer 421*a* needs to be 25% or more of the layer thickness of surface layer 421*b*.

That is, in the case where the layer thickness of surface layer 421*b* is A μm and the surface roughness (ten-point average roughness) of base material layer 421*a* is B μm, the relationship of expression (1) is satisfied:

$$0.25 \times A \leq B \quad (1)$$

In addition, as illustrated in FIGS. 4 and 5, it is confirmed that the increase of the surface roughness Rz of base material layer 421*a* affects the surface roughness Rz of surface layer 421*b*.

Specifically, in FIG. 4, when base material layer 421*a* has a surface roughness Rz of 1.61 μm or less (patterns (3) to (7)), surface layer 421*b* has almost the same surface roughness Rz as base material layer 421*a* of which the surface is not roughened (Comparative Example). In contrast, when the surface roughness Rz of base material layer 421*a* exceeds 1.61 μm (i.e., in patterns (8) and (9)), the surface roughness Rz of surface layer 421*b* is increased.

Similarly, in FIG. 5, when base material layer 421*a* has a surface roughness Rz of 1.19 μm or less (patterns (2) to (5)), surface layer 421*b* has almost the same surface roughness Rz as base material layer 421*a* of which the surface is not roughened (Comparative Example). In contrast, when the surface roughness Rz of base material layer 421*a* exceeds 1.19 μm (i.e., in patterns (6) and (9)), the surface roughness Rz of surface layer 421*b* is increased.

When the surface roughness Rz of surface layer 421*b* increases, the depth of grooves formed in the surface of surface layer 421*b* increases. Thus, for example, in belt cleaning device 426, transfer residual toner is likely to pass through without being removed, which may result in poor cleaning.

In contrast to this, according to the studies of the present inventors, it has been found in the present embodiment that the surface roughness Rz (upper limit) of base material layer 421*a* needs to be 60% or less of the layer thickness of surface layer 421*b* so as not to affect the surface roughness Rz of surface layer 421*b*.

That is, in the case where the layer thickness of surface layer 421*b* is A μm and the surface roughness (ten-point average roughness) of base material layer 421*a* is B μm, the relationship of expression (2) is satisfied:

$$B \leq 0.6 \times A \quad (2)$$

As a result of this, in the present embodiment, the surface roughness Rz (ten-point average roughness) of base material layer 421*a* in intermediate transfer belt 421 may be 25% or more and 60% or less of the layer thickness of surface layer 421*b*. That is, when the surface roughness Rz of base material layer 421*a* is 25% or more of the layer thickness of surface layer 421*b*, adhesiveness between base material layer 421*a* and surface layer 421*b* can be improved. Further, when the surface roughness Rz of base material layer 421*a* is 60% or less of the layer thickness of surface layer 421*b*, it is possible to prevent the cleaning performance from deteriorating due to increase of the surface roughness Rz of surface layer 421*b*.

Thus, in the present embodiment, image forming apparatus 1 can suppress peeling of surface layer 421*b* from base material layer 421*a* due to energization, to thereby prevent deterioration of transfer performance in intermediate transfer belt 421.

For example, by improving adhesiveness between base material layer 421*a* and surface layer 421*b* in intermediate transfer belt 421, image forming apparatus 1 can form a sufficient electric field to move toner to a recessed portion on an uneven paper sheet having uneven surface (e.g., embossed paper), so that excellent transfer performance can be ensured.

In FIGS. 4 and 5, the cases where surface layer 421*b* has layer thicknesses of 2.7 μm and 2.0 μm have been described by way of example, but the layer thickness of surface layer 421*b* is not limited to these values. For example, the layer thickness of surface layer 421*b* may be designed in consideration of transfer performance or the like in image forming apparatus 1, and the surface roughness Rz (B μm) of base material layer 421*a* may be set so as to satisfy the above-mentioned conditions (expressions (1) and (2)) according to the designed layer thickness (A μm) of surface layer 421*b*.

Embodiment 2

Embodiment 1 has described the case of setting the upper limit of the surface roughness Rz of base material layer 421*a*, in consideration of variations in the surface roughness Rz of surface layer 421*b* with increasing the surface roughness Rz of base material layer 421*a* (see, for example, expression (2)). In contrast to this, the present embodiment will describe a case of setting the upper limit of the surface roughness Rz of base material layer 421*a*, in consideration of variations in cleaning performance of belt cleaning device 426 with increasing the surface roughness Rz of base material layer 421*a*.

The present inventors have evaluated the cleaning performance of belt cleaning device 426 by the following method and criteria. In the present embodiment, materials and parameters of image forming apparatus 1 (evaluation machine) used in the evaluation of the cleaning performance are the same as those in the above embodiment (e.g., Table 1).

In the present embodiment, base material layer 421*a* of intermediate transfer belt 421 uses a material including polyimide resin, having a layer thickness of 65 μm, a resistance of 10.2 log Ω/sq, and a surface roughness Rz of 0.6 μm. Surface layer 421*b* of intermediate transfer belt 421 uses a silicon dioxide-based material having a layer thickness of 1.6 μm.

Under the above-mentioned conditions, intermediate transfer belt 421 is manufactured by changing the surface roughness Rz of surface layer 421*b* in the range of 0.4 to 1.5 μm (patterns (1) to (11)). That is, in the following evaluation of the cleaning performance, the variations in the surface roughness Rz of surface layer 421*b*, which are caused by imparting the surface roughness Rz of base material layer 421*a*, are simulatively reproduced by manufacturing intermediate transfer belts 421 having different surface roughnesses Rz of surface layer 421*b*. The method of imparting the surface roughness to intermediate transfer belt 421 that may be used includes a method of grinding the surface of intermediate transfer belt 421; a method of adding particles (e.g., glass beads) or the like of the same component as used in surface layer 421*b* to the raw material and then applying to the belt; a method of using coarse particles for spray application; and the like, but not limited thereto.

FIG. 6 illustrates results of evaluating cleaning performance in image forming apparatus 1 on the above patterns (1) to (11) according to the following criteria.

Specifically, as the method of evaluating the cleaning performance, when the amount of toner adhered on intermediate transfer belt 421 was 8 gsm and the toner was entered into belt cleaning device 426, the cleaning performance was evaluated according to the remaining of wiping of the toner as follows.

A (Excellent): Toners are completely wiped off.

B (Good): Some toners are left unwiped, but practically allowable.

C (Poor): Some toners are left unwiped, and practically not allowable.

As illustrated in FIG. 6, the cleaning performance was evaluated as "A (Excellent)" when the surface roughness Rz of surface layer 421*b* was 1.2 μm or less (patterns (1) to (8)); "B (Good)" when the surface roughness Rz of surface layer 421*b* was 1.3 μm (pattern (9)); and "C (Poor)" when the surface roughness Rz of surface layer 421*b* was 1.4 μm or more (patterns (10) and (11)). That is, the surface roughness Rz of surface layer 421*b* is preferably 1.3 μm or less from the viewpoint of the cleaning performance.

Further, as illustrated in FIG. 6, the surface roughness Rz of surface layer 421*b* is more desirably a value in the range of 1.2 μm or less. Setting the surface roughness Rz of surface layer 421*b* within the range of 1.2 μm or less can provide excellent cleaning performance ("A (Excellent)").

As described above, in the present embodiment, the upper limit of the surface roughness Rz of base material layer 421*a* is determined by the cleaning performance. Here, the cleaning performance varies depending on the particle size of the toner used for formation of a toner image to intermediate transfer belt 421. For example, the toner used in the evaluation illustrated in FIG. 6 has an average particle size of 7 μm, and as illustrated in FIG. 6, the upper limit of the surface roughness Rz of surface layer 421*b* needs to be 1.3 μm or 1.2 μm (i.e., pattern (8) or (9) in FIG. 6) or less. Therefore, according to the studies of the present inventors, it has been found that the surface roughness Rz of surface layer 421*b* needs to be less than 20% relative to the particle size (average particle size) of the toner.

In order to set the surface roughness Rz of surface layer 421*b* to less than 20% of the particle size of the toner regardless of the layer thickness of surface layer 421*b* of intermediate transfer belt 421, the surface roughness Rz of base material layer 421*a* adjacent to surface layer 421*b* may be set to less than 20% of the average particle size of the toner.

Thus, in the present embodiment, image forming apparatus 1 can suppress peeling of surface layer 421*b* from base material layer 421*a* due to energization, to thereby prevent deterioration of transfer performance in intermediate transfer belt 421, similarly to Embodiment 1, and can obtain excellent cleaning performance in belt cleaning device 426.

Embodiment 3

In the present embodiment, the design range of the layer thickness of surface layer 421*b* is defined.

Figure 7:
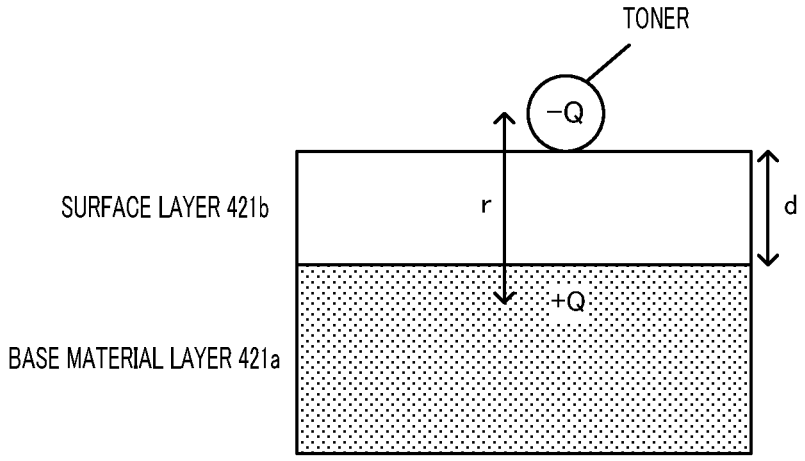
FIG. 7 is a diagram used to explain a principle of improving transfer efficiency with the surface layer.

As illustrated in FIG. 7, intermediate transfer belt 421 includes base material layer 421*a* (PI layer) and surface layer 421*b* (coat layer) having a higher resistance than base material layer 421*a*. In such a case, when the toner is adhered to intermediate transfer belt 421 by the primary transfer, electric charge (+Q) opposite to the toner generates in base material layer 421*a* because the resistance of surface layer 421*b* is high.

Here, an electrostatic adhesion force F between a toner and intermediate transfer belt 421 is represented by the following expression (3).

[Equation 1]

$$F = \frac{1}{4\pi\varepsilon} \times \frac{q^2}{r^2} \tag{3}$$

Specifically, the electrostatic adhesion force between the toner and intermediate transfer belt 421 decreases as a distance r between the toner and the counter charge increases. When the electrostatic adhesion force between the toner and intermediate transfer belt 421 decreases, the transfer efficiency (transfer performance) is improved. Therefore, in intermediate transfer belt 421 illustrated in FIG. 7, as the layer thickness ("d") of surface layer 421*b* increases, the distance r between the toner and the counter charge increases, so that the transfer efficiency is improved.

Meanwhile, surface layer 421*b* of intermediate transfer belt 421 contains an organic component to prevent occurrence of a crack. However, even though surface layer 421*b* contains an organic component, a crack may occur in surface layer 421*b* due to stress caused by curvature of the stretching roller or a pressing force at the transfer nip (primary transfer nip or secondary transfer nip). In particular, a crack is likely to occur in surface layer 421*b* having a larger layer thickness d.

Therefore, the layer thickness d of surface layer 421*b* is desirably designed at least in consideration of both ensuring excellent transfer performance and preventing occurrence of a crack in surface layer 421*b*. Then, the present embodiment will describe the design of the layer thickness of surface layer 421*b* that can ensure excellent transfer performance while occurrence of a crack in surface layer 421*b* is prevented.

The present inventors have evaluated transfer performance and occurrence of a crack by the following method and criteria. In the present embodiment, materials and parameters of image forming apparatus 1 (evaluation machine) used in the evaluation of transfer performance and occurrence of a crack are the same as those in the above embodiment (e.g., Table 1).

In the present embodiment, surface layer 421*b* has a surface roughness Rz of 0.6 μm. However, the surface roughness Rz is not limited to 0.6 μm. For example, the surface roughness Rz of surface layer 421*b* may correspond to the case where the surface roughness Rz of base material layer 421*a* is a value within the range described in Embodiment 1 or 2.

Under the above-mentioned conditions, intermediate transfer belts 421 are manufactured by changing the layer thickness d of surface layer 421*b* in the range of 0.4 to 3.4 μm (patterns (1) to (13)). The layer thickness d is an average value of the layer thicknesses measured at any 12 points on intermediate transfer belt 421.

FIG. 8 illustrates results of evaluating transfer performance and occurrence of a crack in image forming apparatus 1 on the above patterns (1) to (13) according to the following criteria.

Specifically, as the method of evaluating the transfer performance, a solid image was output on an embossed paper (LEATHAC 66, white, 302 gsm, manufactured by Tokushu Tokai Paper Co., Ltd.) ("LEATHAC" is a registered trademark of the same company), and blank levels on recessed portions were ranked to evaluate the transfer performance as follows.

A (Excellent): No blank is present.

B (Good): Some blank portions are present, but practically allowable.

C (Poor): Blank portions are present, and practically not allowable.

D (Bad): Entirely blank.

Further, as the method of evaluating a crack in surface layer 421*b*, the primary transfer and the secondary transfer were press-contacted, voltages of 2 kV and 3 kV were applied thereto, respectively, idle running was conducted for 200 hr, and thereafter, the presence or absence of a crack on its surface was evaluated by visual observation as follows.

A (Good): No crack is present.

B (Bad): A crack is present.

As illustrated in FIG. 8, the transfer performance was evaluated as "D (Bad)" when the layer thickness of surface layer 421*b* was 0.4 μm (pattern(1)); "C (Poor)" when the layer thickness of surface layer 421*b* was 0.6 or 0.8 μm (patterns (2) and (3)); "B (Good)" when the layer thickness of surface layer 421*b* was 1.0 or 1.2 μm (patterns (4) and (5)); and "A (Excellent)" when the layer thickness of surface layer 421*b* was 1.4 μm or more (patterns (6) to (13)). That is, the layer thickness of surface layer 421*b* is preferably 1.0 μm or more from the viewpoint of ensuring the transfer performance.

That is, the surface layer 421*b* having a layer thickness of 1.0 μm or more allows image forming apparatus 1 to ensure excellent transfer performance even on the recessed portion of the embossed paper.

Further, as illustrated in FIG. 8, the crack in surface layer 421*b* was evaluated as "A (Good)" when the layer thickness of surface layer 421*b* was 3 μm or less (patterns (1) to (11)) and "B (Bad)" when the layer thickness of surface layer 421*b* was 3.2 μm or more (patterns (12) and (13)). That is, the layer thickness of surface layer 421*b* is preferably 3.0 μm or less from the viewpoint of evaluation of a crack in surface layer 421*b*.

From the foregoing, in the evaluation results illustrated in FIG. 8, the layer thickness of surface layer 421*b* is desirably a value in the range of 1.0 μm or more and 3.0 μm or less in consideration of both transfer performance and preventing occurrence of a crack. Specifically, when the layer thickness of surface layer 421*b* is less than the lower limit (1.0 μm), for example, the distance r illustrated in FIG. 7 decreases, so that the electrostatic adhesion force between the toner and intermediate transfer belt 421 increases, resulting in deterioration of the transfer performance. Further, when the layer thickness of surface layer 421*b* is higher than the upper limit (3.0 μm), a crack occurs.

As illustrated in FIG. 8, the layer thickness of surface layer 421*b* is more desirably a value in the range of 1.4 to 3.0 μm. The surface layer 421*b* having a layer thickness in the range of 1.4 to 3.0 μm can provide excellent transfer performance ("A (Excellent)") without generating a crack.

Thus, according to the present embodiment, image forming apparatus 1 can ensure excellent transfer performance while preventing occurrence of a crack in intermediate transfer belt 421.

The embodiments have thus been described.

The above embodiment has described the case where the intermediate transfer belt includes two layers of base material layer 421*a* and surface layer 421*b*. However, intermediate transfer belt 421 may include three or more layers. For example, intermediate transfer belt 421 may include, in addition to base material layer 421*a* and surface layer 421*b*, an intermediate layer (not illustrated) disposed between base material layer 421*a* and surface layer 421*b*. The intermediate layer may have an elastic layer, for example. The elastic layer may be based on, for example, a rubber in which a conductive material or the like is dispersed. The rubber included in the elastic layer may be an acrylonitrile-butadiene rubber, a butadiene rubber, a chloroprene rubber, a urethane rubber, or the like, but not limited thereto. In this case, the same surface roughness as that imparted to base material layer 421*a* in the above embodiment may be imparted to the intermediate layer adjacent to surface layer 421*b* in order to improve adhesiveness to surface layer 421*b*. This can also suppress peeling of surface layer 421*b* from the intermediate layer due to energization, to thereby prevent deterioration of transfer performance in intermediate transfer belt 421 including the intermediate layer, similarly to the above embodiment.

In the above embodiment, intermediate transfer belt 421 may further include a protective layer on surface layer 421*b*. This can suppress deterioration of surface layer 421*b*.

Further, the above embodiment has described intermediate transfer belt 421 (intermediate transfer member) as an image carrier including a base material layer and a surface layer disposed on the base material layer. However, the present invention is not limited thereto, and can also be applied to another image carrier (e.g., photoconductor drum 413) on which the amount of a toner image adhered is detected.

Although embodiments of the present invention have been described and illustrated in detail, the disclosed embodiments are made for purpose of illustration and example only and not limitation. The scope of the present invention should be interpreted by terms of the appended claims.

What is claimed is:

1. An image carrier, comprising:

a first layer; and a surface layer disposed on the first layer and including an inorganic oxide containing an organic component, wherein, when the surface layer has a layer thickness of A μm and the first layer has a ten-point average roughness of B μm, a relationship of an expression (1) is satisfied:

$$0.25 \times A \leq B \quad (1).$$

2. The image carrier according to claim 1, wherein a relationship of an expression (2) is further satisfied:

$$B \leq 0.6 \times A \quad (2).$$

3. The image carrier according to claim 1, wherein the ten-point average roughness of the first layer is less than 20% of an average particle size of a toner used for formation of a toner image to the image carrier.

4. The image carrier according to claim 1, wherein the surface layer has a layer thickness of 1.0 μm or more and 3.0 μm or less.

5. An image forming apparatus, comprising the image carrier according to claim 1.

* * * * *